United States Patent [19]

Maykemper et al.

[11] 4,189,258

[45] Feb. 19, 1980

[54] WALKING MINE-ROOF SUPPORT

[75] Inventors: Alfred Maykemper; Hans-Jürgen Kahl, both of Wuppertal, Fed. Rep. of Germany

[73] Assignee: Hermann Hemscheidt Maschinenfabrik GmbH & Co., Wuppertal, Fed. Rep. of Germany

[21] Appl. No.: 927,951

[22] Filed: Jul. 25, 1978

[30] Foreign Application Priority Data

Sep. 22, 1977 [DE] Fed. Rep. of Germany ..... 2742650
Sep. 29, 1977 [DE] Fed. Rep. of Germany ..... 2743776

[51] Int. Cl.[2] ..... E21D 15/44
[52] U.S. Cl. ..... 405/291
[58] Field of Search ..... 405/291–299; 299/31–33; 91/170 MP; 248/357

[56] References Cited

U.S. PATENT DOCUMENTS 3,115,754 12/1963 Joseph ..... 405/297
3,621,661 11/1971 Allen ..... 405/293

FOREIGN PATENT DOCUMENTS 1089710 9/1960 Fed. Rep. of Germany ..... 405/291
1109630 6/1961 Fed. Rep. of Germany ..... 405/291
1195253 6/1965 Fed. Rep. of Germany ..... 405/291
2,363,487 7/1975 Fed. Rep. of Germany ..... 405/291
2,363,488 7/1975 Fed. Rep. of Germany ..... 405/291

*Primary Examiner*—Dennis L. Taylor
*Attorney, Agent, or Firm*—Berman, Aisenberg & Platt

[57] ABSTRACT

A walking mine-roof support comprising two roof support units which are to be moved with respect to one another for advancing the support, each of the units including a pair of spaced-apart frames each comprising a pair of hydraulically-extensible props disposed one at each side of the frame connected to a cross-member extending between the props, the two frames of each unit being interconnected by roof-supporting bars connected to the cross-members of the frames, the two roof support units overlapping one another in the direction of advance of the support so that first and third frames form a leading one of the units and second and fourth frames form the other unit which is a trailing unit, the two frames of one unit being connected to a frame of the other unit disposed between the two frames by respective first and second rams, whereby during relative movement between the units one of the rams is extended while the other retracts.

9 Claims, 4 Drawing Figures

WALKING MINE-ROOF SUPPORT

This invention relates to a mine-roof support arrangement comprising a roof support unit having a pair of spaced-apart frames, each frame comprising a pair of hydraulically-extensible props disposed one at each side of the frame and a cross-member connected to and extending between the props, the two frames being interconnected by roof-supporting bars which extend between the frames and are connected to the cross-members of both frames. The cross-members can be straight, angled or curved, according to the cross-sectional shape of a roof to be supported.

The invention is particularly, but not exclusively, concerned with a roof support arrangement in which two such roof support units are combined to form a walking roof support suitable for use at the work face of, say, a coal mine, for temporarily supporting the roof above a winning machine as the face is advanced. In operation, the two units of such a walking roof support overlap one another longitudinally, i.e. in the direction of advance, so that the frame nearest the workface will be part of one unit, i.e. a leading unit, the next frame to it will be part of the other (trailing) unit, the next frame to that will be part of the leading unit, and the remaining frame remote from the workface will form part of the trailing unit. For convenience in the following description, the frames will be referred to as the first, second, third and fourth frames, and first frame being the one which, in use, is nearest the work face at any particular instant. Thus, the first and third frames comprise the leading unit and the second and fourth frames the trailing unit. The bars of the two units will be interleaved with one another across the roof so that alternate bars are connected to alternate units, and the bars of one unit overlie the cross member of one of frames of the other unit.

A walking roof support of the construction described above is shown U.K. Pat. No. 905,379. However, the support shown in that patent has several disadvantages. For varying the amount by which the units overlap, and therefore the size of the "steps" by which the support "walks", the first and fourth frames are interconnected by double-acting rams. Thus the distance between the first and fourth frames and thus the total length of the support is limited by the maximum practicable length of the rams, since very long rams will obviously have a tendency to bend or buckle. Because of this problem, it has been proposed to provide roof-supporting bars which extend beyond the frames. This is not a very satisfactory solution, however, and it does nothing to alleviate another problem associated with long rams, i.e. the difficulty which occurs when the walking support has to follow a bend as the workface advances.

Another disadvantage is that the rams encroach upon the area in which the winning machine operates, so that the rams may be damaged by the winning machine.

A further disadvantage is that the bars which engage the roof are not designed to follow any uneveness in the roof, so that some bars carry more load than others.

It is an aim of the present invention to overcome these drawbacks, and according to the invention a walking mine roof support comprises two roof support units which are to be moved with respect to one another for advancing the support, each of the units including a pair of spaced-apart frames each comprising a pair of hydraulically-extensible props disposed one at each side of the frame connected to a cross-member extending between the props, the two frames of each unit being interconnected by roof-supporting bars connected to the cross-members of the frames, the two roof support units overlapping one another in the direction of advance of the support so that first and third frames form a leading one of the units and second and fourth frames form the other unit which is a trailing unit, the two frames of one unit being connected to a frame of the other unit disposed between the two frames by respective first and second rams, whereby during relative movement between the units one of the rams is extended while the other retracts.

The use of two rams arranged according to the invention instead of one long ram extending from the first to the fourth frame overcomes the disadvantages described above which resulted from the use of the long arm.

According to another aspect of the invention, a mine roof support unit has a mine-roof support unit having a pair of spaced-apart frames, each frame comprising a pair of hydraulically-extensible props disposed one at each side of the frame connected to a cross-member extending between the props, the two frames of the unit being interconnected by roof-supporting bars connected to the cross-members of the frames, each bar being supported from a cross-member by four rams arranged in two pairs, the two rams of each pair being connected one at each side of a cross-member and diverging upwardly from the cross member, all four of the bar-supporting rams being equally spaced around a central point.

An exemplary embodiment of a walking mine-roof support according to the invention will now be described with reference to the accompanying drawings, in which.

Figure 1:
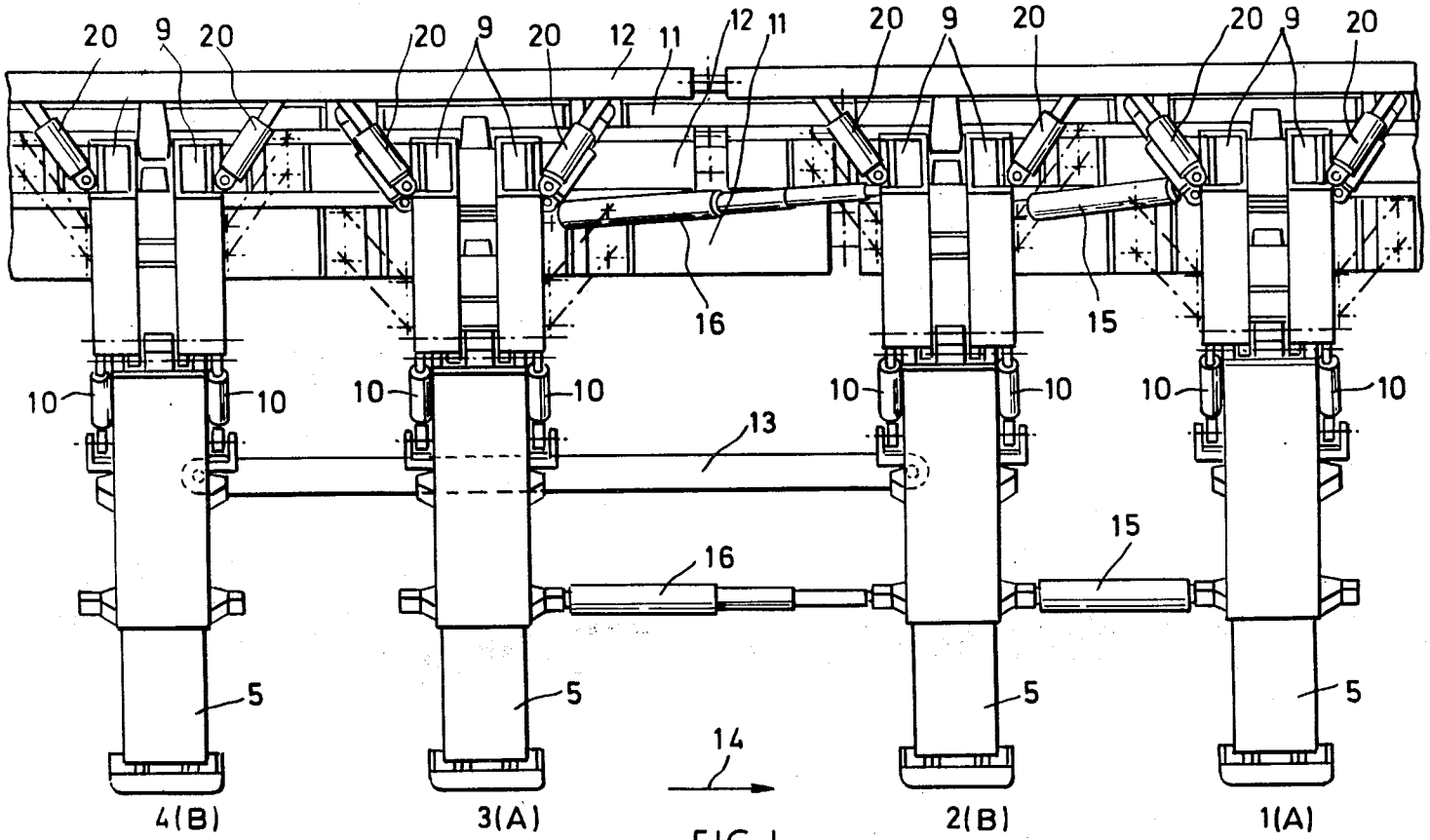
FIG. 1 is a sectional side view of a walking roof support comprising two overlapping support units each comprising two interconnected frames.
Figure 2:
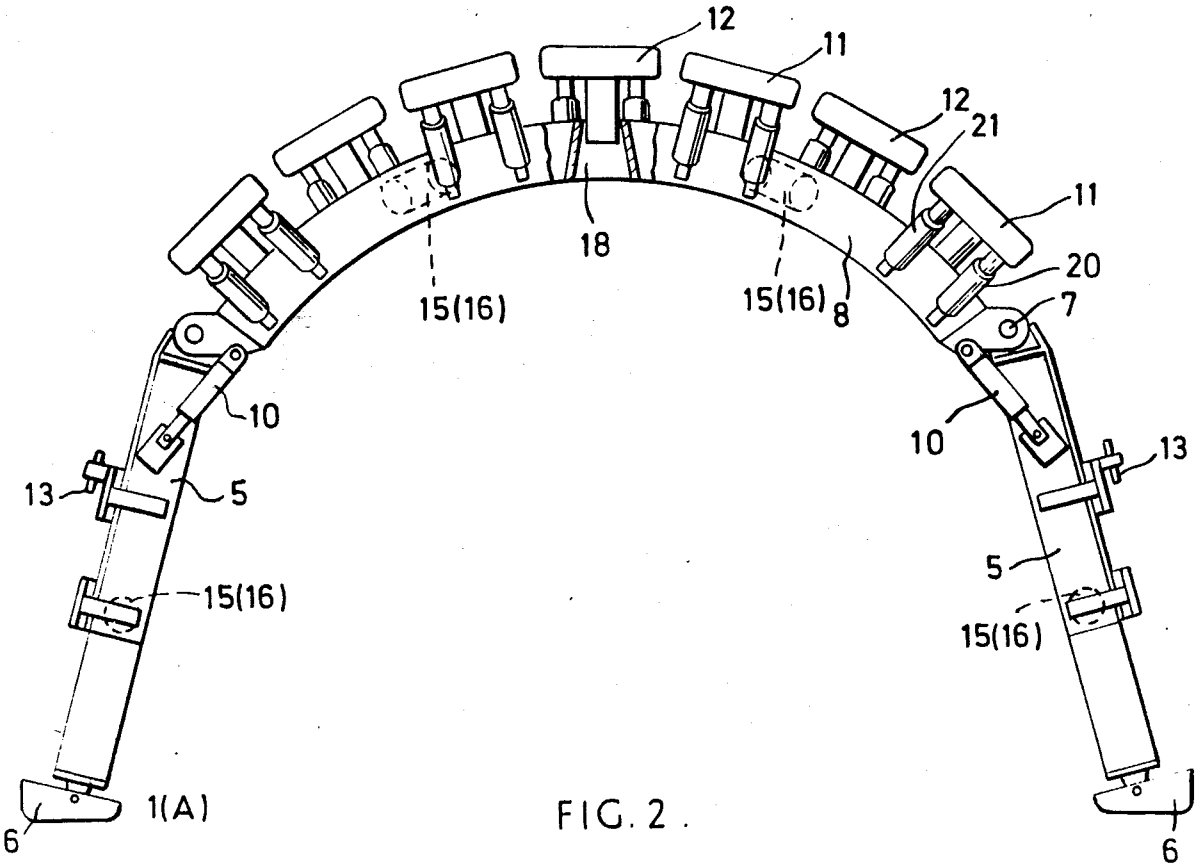
FIG. 2 is a vertical sectional view of the walking roof support of FIG. 1, showing a frame of one of the support units.

Referring firstly, to FIGS. 1 and 2, there is shown a walking roof support comprising four arch-shaped frames 1,2,3,4. Each frame comprises a pair of hydraulically extensible props 5 disposed one at each side of the arch. The lower end of each prop 5 is pivotally connected to a ground-engaging member 6, and the upper end of each prop is connected by a pivot pin 7 to an arcuate cross-member 8. Double-acting hydraulic rams 10 are connected between each prop 5 and its associated cross-member 8 for the purpose of pivoting the prop 5 about pins 7 as will be explained below. It will be appreciated that the cross-member 8 need not be arcuate, but could instead be straight or angled.

Frames 1 and 3 form a leading roof-support unit A which will be nearest the workface. The transverse cross-members 8 of frames 1 and 3 support longitudinal roof-supporting bars 11 in a manner described in more detail below so that the spacing between frames 1 and 3 is maintained substantially constant by the bars 11. Similarly, the cross-members 8 of frames 2 and 4 support bars 12 which maintain substantially constant the spacing between frames 2 and 4, which frames constitute a trailing roof support unit B. Frames 2 and 4 are also interconnected by tie bars 13. Thus, the units A and B overlap one another longitudinally, i.e. in the direction of advance indicated by arrow 14 in FIG. 1, and the bars 11 and 12 of respective units A and B are interleaved.

For varying the distance by which the units A and B overlap and thus the distance or steps by which the support "walks", the frames 1 and 2 are interconnected by several double-acting rams 15, and the frames 2 and 3 are interconnected by several double-acting rams 16. As shown in FIG. 2, a pair of the rams 15 interconnect the cross-members 8 of frames 1 and 2, and a pair of the rams 15 interconnect the props 5 of frames 1 and 2. The rams 16 are similarly arranged between frames 2 and 3. It is a particularly advantageous feature of the illustrated embodiment that the rams 15 and 16 are contained within the outline of the frames as viewed in FIG. 2, i.e. the rams do not encroach upon the arch-shaped space in which a winning machine (not shown) will operate.

The manner in which each longitudinal roof-supporting bar is supported from its two associated frames will now be described with reference to FIGS. 3 and 4.

At each of the regions where a bar 11 is connected to a frame (1 or 3), the bar has a depending guide pin 17 which is arranged to slide up and down in a recess 18 formed in the cross member 8. As viewed in FIG. 2, each pin 17 has a pair of straight side walls which are guided by downwardly-diverging walls of the recess 18 whereas, as viewed in FIG. 3, the other two sides of the pin taper both upwardly and downwardly from a region 19 of widest cross-section, whereas the sides of the recess 18 are straight.

Figure 3:
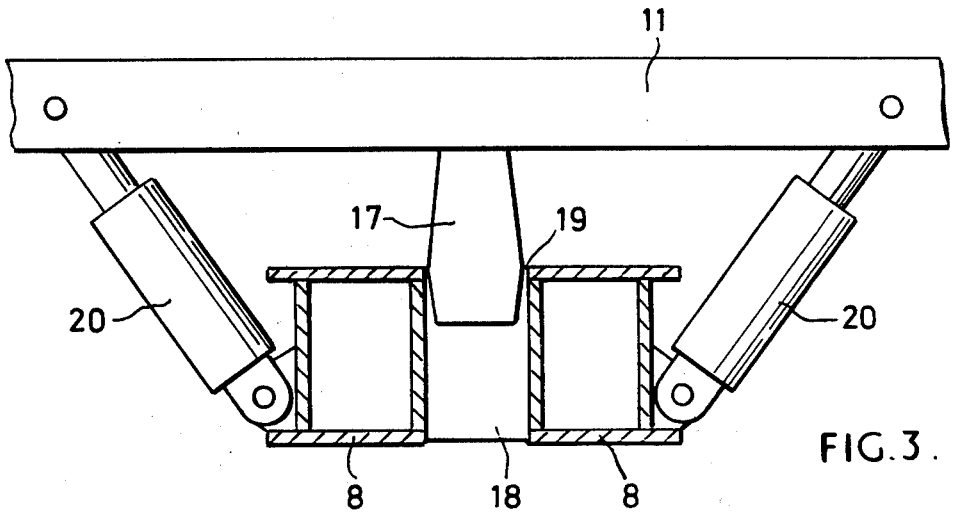
FIG. 3 is a detail of FIG. 1 on a larger scale showing the mounting of a roof-supporting bar on a cross-member of a frame.
Figure 4:
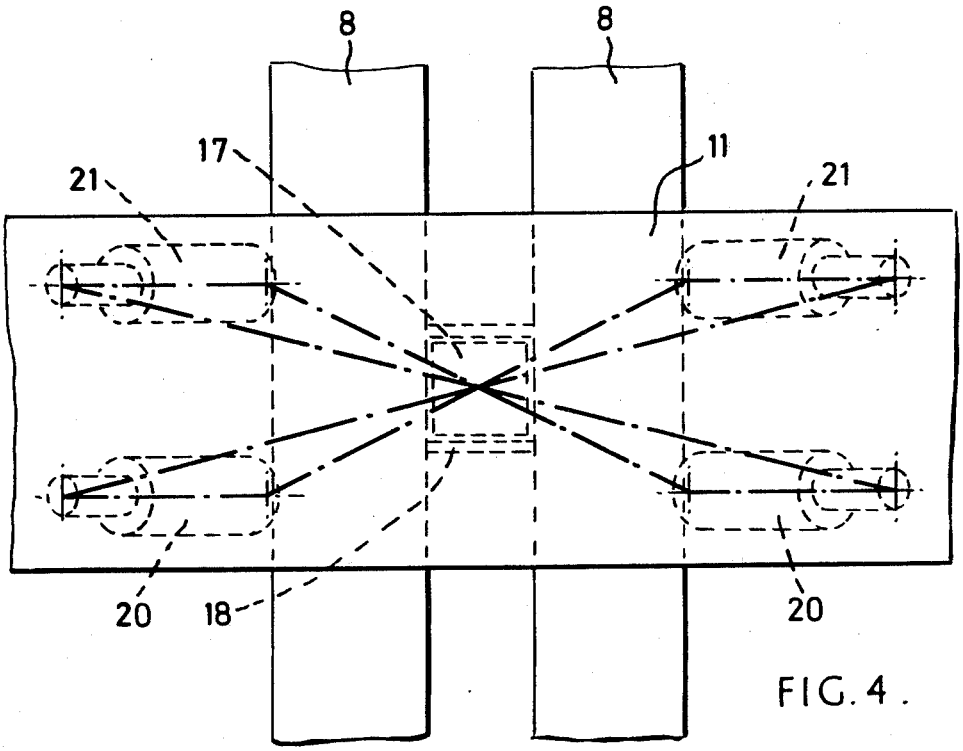
FIG. 4 is a top plan view of the detail shown in FIG. 3.

As shown in FIG. 3, a pair of hydraulically-extensible rams 20 are pivotally connected between the cross-member 8 of frame 1 and the bar 11. The rams 20 are connected one on each side of the cross member 8 and diverge upwardly in a 'V' formation. As shown in FIG. 4, a second pair of rams 21 like the rams 20 also serve to connect the cross-member 8 to the bar 11, the rams 20 and 21 all being equally spaced from the guide pin 17.

It will be understood that the bars 11 are connected to the cross members of both frames 1 and 3 in a similar manner, and that the bars 12 are also connected in a similar manner to the cross-members of frames 2 and 4. The rams 20 and 21 will have excess-pressure valves (not shown) to protect them.

Operation of the walking support will now be described. The normal position of units A and B is a retracted one in which the overlap of the units is a maximum. In order to advance the walking support, the rams 20 and 21 of frames 1 and 3 are retracted to cause the bars 11 of frames 1 and 3 to rest on or lie just above the cross-members 8 of frames 2 and 4. The props 5 of frames 1 and 3 are then retracted and also pivoted inwardly by rams 10 so that the props are clear of the side walls of the mine. In this position the unit A is supported by its bars 11 on the cross-members 8 of unit B. The bars 12 of unit B will, however, still support the roof. In order to cause the leading unit A to be advanced, rams 15 are extended and, simultaneously, rams 16 are retracted by the same amount that rams 15 are extended.

The props 5 of frames 1 and 3 are again provided outwardly by rams 10 and then extended. The cylinders 20 and 21 of all the bars 11 are then simultaneously extended to support the roof.

The unit B will then be drawn up to unit A by retracting cylinders 20,21 associated with frames 2 and 4, retracting and pivoting inwardly props 5 of frames 2 and 4, extending props 16 and, simultaneously, retracting props 15, resetting props 5, and extending the appropriate cylinders 20 and 21 to raise the bars 12 to assist bars 11 in supporting the roof.

The problems arising from the use of a set of long rams extending between the first and fourth frames as used in the prior art are therefore avoided by the use of two sets of shorter rams 15 and 16. Thus, the rams show little tendency to bend or buckle, and the overall length between frames 1 and 4 can be as much as 6 meters without giving rise to difficulties.

The units A+B can pivot with respect to one another to a limited extent as they slide relatively to one another so that the walking support can follow a bend as the face advances. The extent of pivoting movement will be limited by engagement between the interleaved bars 11 and 12.

The fact that the rams 15 and 16 are disposed centrally within the outline of the frames not only protects them from damage, but also stops one unit from rotating (i.e. sliding along the cross-members 8 as opposed to sliding across the members 8) with respect to the other unit as the walking support is advanced.

A particular advantage conferred by the arrangement of the cylinders 20 and 21 is that the bars of a unit A,B will be maintained accurately at right angles to the cross-members 8 of that unit as the cylinders 20,21 are extended.

The bars are also adapted to bear the roof load more evenly than in the support described in U.S. Pat. No. 905,379, where the bars are not supported on hydraulic rams.

We claim:

1. A walking mine-roof support comprising first, second, third and fourth frames, said first and third frames forming a first roof support unit, said second and fourth frames forming a second roof support unit, said units being movable with respect to one another for advancing the support, the respective frames in each unit being spaced-apart and each comprising a pair of hydraulically-extensible props disposed one at each side of the respective frame, means connecting each pair of props to a respective cross-member extending between the props, roof-supporting bars interconnecting the two frames of each unit by being connected to the respective cross-members of the frames, the two roof support units overlapping one another in the direction of advance of the support so that the first roof support unit having said first and third frames forms a leading one of the units and the second roof support unit having said second and fourth frames forms a trailing unit, the two frames of one unit being connected to a frame of the other unit disposed between the said two frames by respective first and second rams, whereby during relative movement between the units one of the rams is extended while the other retracts.

2. A walking mine-roof support according to claim 1, in which the first ram connects the first frame to the second frame and the second ram connects the second frame to the third frame so that, in a retracted position of the support when the overlap between the units is a maximum, the distance between the first and second frames is determined by the retracted length of the first ram, and the distance between the second and third frames is determined by the extended length of the second ram.

3. A walking mine-roof support according to claim 1, in which there are four first rams and four second rams, each pair of frames connected by the rams having their cross-members interconnected by two of the rams and having their respective adjacent props interconnected by the two remaining rams, one disposed at each side of the frames.

4. A walking mine-roof support according to claim 1, in which the said rams are double-acting hydraulic rams.

5. A walking mine-roof support according to claim 1, in which the rams are located within the outline of the frames whereby they do not extend into the space enclosed by the support to form an obstruction.

6. A mine-roof support unit having a pair of spaced-apart frames, each frame comprising a pair of hydraulically-extensible props disposed one at each side of the frame connected to a cross-member extending between the props, the two frames of the unit being interconnected by roof-supporting bars connected to the cross-member by four rams arranged in two pairs, the two rams of each pair being connected one at each side of a cross-member and diverging upwardly from the cross-member, all four of the bar-supporting rams being equally spaced around a central point.

7. A mine-roof support according to claim 6, in which each bar carries a depending guide pin which extends through the central point and is slidably received in a recess in a cross-member for guiding the bar as it is moved vertically by the bar-supporting rams.

8. A mine-roof support according to claim 7, in which the guide pin has a tapering cross-section.

9. A mine-roof support according to claim 7, in which the recess has a tapering cross-section.

* * * * *